United States Patent [19]

Collins

[11] 4,386,762

[45] Jun. 7, 1983

[54] FENCE

[76] Inventor: Jake Collins, 11724 80th Ave. Northeast, Kirkland, Wash. 98033

[21] Appl. No.: 289,740

[22] Filed: Aug. 3, 1981

[51] Int. Cl.[3] ..... E04H 17/14; E02D 27/00

[52] U.S. Cl. ..... 256/59; 256/65; 256/DIG. 5; 52/297

[58] Field of Search ..... 256/19, 21, 22, 24, 256/53, 52, 57, 59, 65, DIG. 5; 52/295, 296, 297

[56] References Cited

U.S. PATENT DOCUMENTS

| | | | |
|---|---|---|---|
| 500,635 | 7/1893 | Van Wagoner | 256/59 |
| 870,554 | 11/1907 | Gargett | 52/297 X |
| 2,718,382 | 9/1955 | Bird | 256/65 X |
| 2,856,652 | 10/1958 | Colton | 256/59 X |
| 3,109,629 | 11/1963 | McKee | 256/59 |
| 3,785,107 | 1/1974 | Garretson | 256/59 X |

*Primary Examiner*—Richard J. Scanlan, Jr.
*Attorney, Agent, or Firm*—Seed, Berry, Vernon & Baynham

[57] ABSTRACT

A low-cost fence is essentially free from ground rot. The novel fence post of this invention capitalizes on the structural rigidity of rectangular tubular members. The fence post has a concrete reinforcing rod projecting downwardly into concrete from the tubular member and small-dimensioned lumber bolted to the tubular member and extending upwardly from the other end. This fence post makes it easy to construct a variety of fences, all of which reduce toenailing and nail bracketing by using spanning rails. Long rails span fence posts in a staggered pattern, thereby gaining additional cantilever strength while reducing the number of posts required.

10 Claims, 10 Drawing Figures

FIG. 1
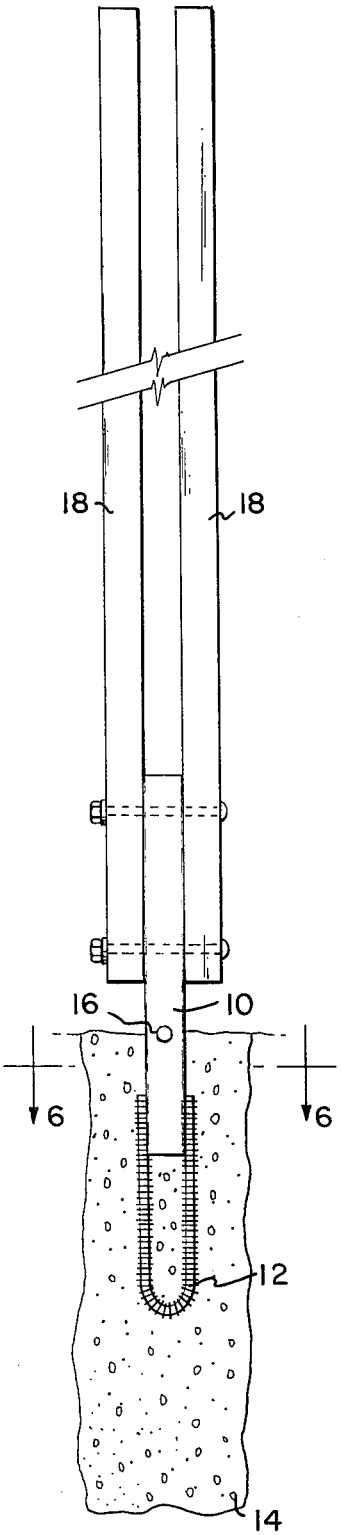
FIG. 2
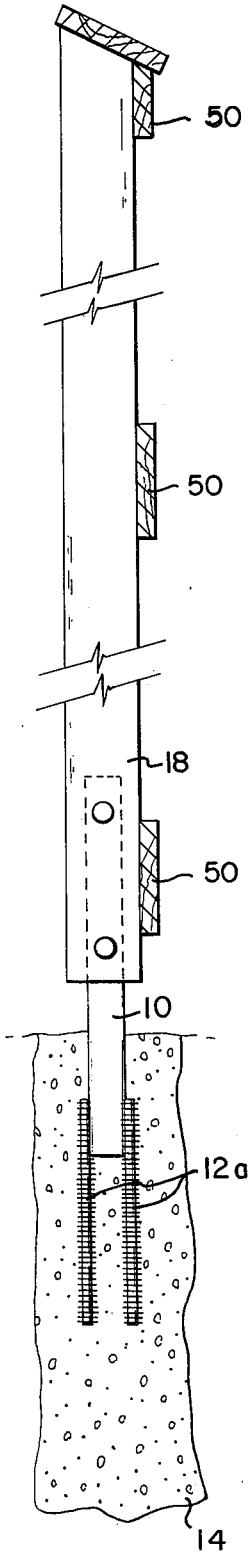
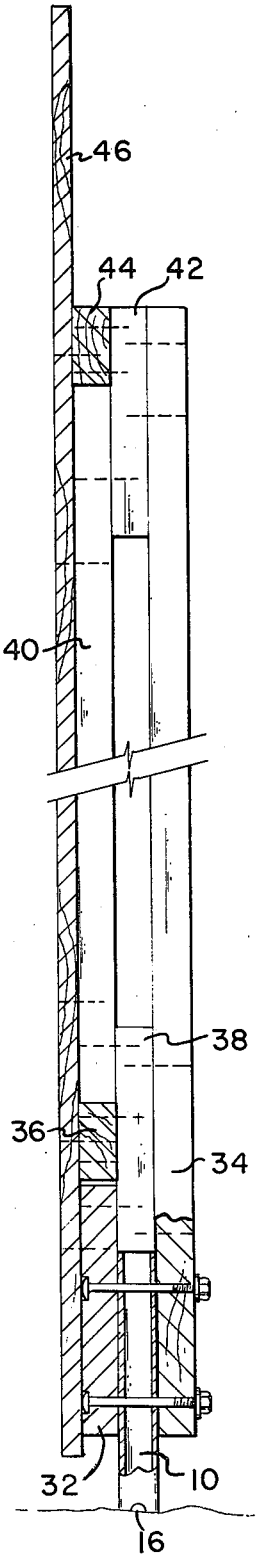
FIG. 3
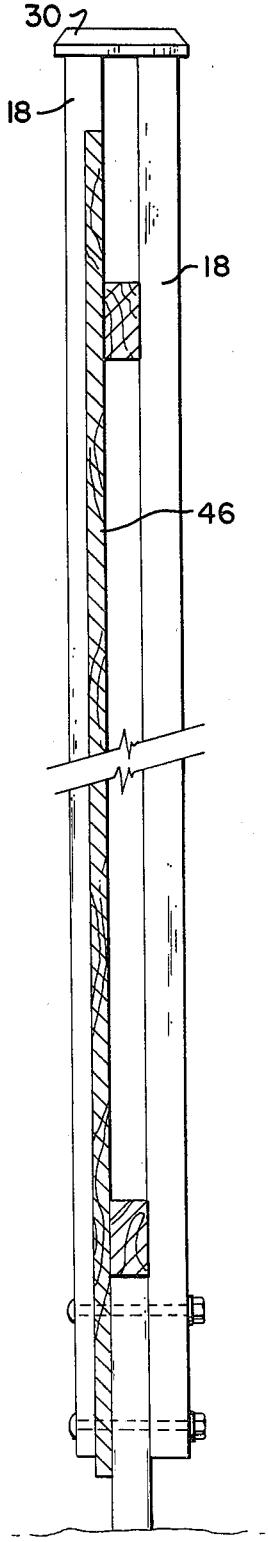
FIG. 4

FENCE

TECHNICAL FIELD

This invention relates to an improvement in making fences. More particularly, this invention utilizes a novel fence post to construct different types of fences, all of which are resistant to post rot. The fence post comprises a square or rectangular metal tubing having a generally U-shaped stirrup projecting downwardly and embedding in concrete. A pair of small-dimensioned, wooden upright members are attached to the upper end of the tubing to support fence rails.

BACKGROUND ART

Three basic methods have been used to embed a fence post in concrete. In the first, the wooden post is often directly embedded into the concrete. In the second, the fence post may be counterbored on its bottom and placed upon a metal pipe which is then embedded in the concrete. In the third method, the fence post may have an "A"-shaped bracket attached to opposite sides of the outside of the post to project downwardly into the concrete.

With the increasing cost of larger dimensioned lumber, it is desirable to replace a larger dimensioned fence post with two smaller dimensioned members if the new post will have sufficient strength. The improved fence post of this invention capitalizes on the strength of square or rectangular metal tubing and the relatively inexpensive cost of smaller dimensioned lumber to provide a durable and rot-resistant fence post.

Numerous patents have been obtained on various improvements in fences. For example, in U.S. Pat. No. 3,892,056, fence posts are set in either mortar or dirt in the post-in-concrete method of erecting a fence. In U.S. Pat. No. 3,993,289, fence posts are set on poles which have been set in the ground in the post-on-a-pipe method of constructing a fence. Other known patented fences are:

| Inventor | U.S. Pat. No. |
|---|---|
| Clark | 115,165 |
| Bird | 2,718,382 |
| Bondy | 1,136,999 |
| Rich | 1,720,004 |
| McDougall | 351,194 |
| Schuck | 2,295,271 |
| Kyle | 917,083 |
| Buchtel | 709,300 |
| Gleason | 266,988 |
| Dewey | 191,944 |

DISCLOSURE OF INVENTION

The basic element of the improved fences of this invention is a novel fence post which is designed specifically for setting in concrete. The post comprises a metal tubular member having at least one bolt hole at one end to which wooden uprights may be bolted. At the other end, the member has at least two concrete reinforcing rods (or a stirrup) which project downwardly from the inside or outside of the member and are used to set the member in concrete. When set in concrete, the reinforcing rods give added strength to the concrete, thereby adding to the structural integrity of the post. This fence post is an improvement over prior posts because it is easy to install and easy to construct.

Ordinarily, two uprights will be bolted to straddle the upper part of the tubular member. Thus the tubular member and the uprights form a fence post usually having a space between the uprights through which long rails may be placed. Precision cutting is reduced or eliminated because minor differences in the length of rails can be accommodated within the space between the uprights. Fences constructed with the posts of this invention are therefore less expensive both in materials and in labor costs.

Almost all types of wood fences can be easily constructed with the fence posts of this invention. Framing methods for three of the most popular fence types will be discussed: estate or exposed post fences, flush-face framed fences, and horizontal rail livestock fences.

An estate fence of this invention runs rails through the spaces between the uprights and attaches fence boards to the rails, leaving the posts exposed from both sides.

A flush-face framed fence has rails incorporated into the uprights. Boards are then nailed to the rails entirely along the face of the fence, completely concealing the wooden part of the posts along the boarded side.

A livestock fence rotates the fence posts ninety degrees from those of the other fences and runs rails to span three posts. The rails are in substantial abutment at every other upright and are cut by overlapping each rail and running a chain saw or other cutting means through the guide formed by the space between the individual uprights. This method of making joints at every other post makes for rapid and accurate rail installation.

These fences are designed to eliminate ground rot. The metal tubular member is set in concrete before the wooden members are bolted on, thereby holding the wooden members above the ground, thereby eliminating any ground rot effects.

The reinforcing stock which projects downwardly from the tubular member has two desirable attributes as compared to a single tubular member having the same overall length. First, the relatively short tubular member in combination with the reinforcing stock requires less metal than a longer tubular member, and therefore costs less. Second, when surrounded by the concrete, the reinforcing stock causes the fence to be substantially sturdier than it would be with the tubular member alone.

The wooden uprights projecting upwardly from the tubular member are designed to accept long horizontal rails that run through the posts or adjacent to them for all common types of wood fencing. Fewer cuts are required when using longer rails, and butt joints may be sloppy as they will not be exposed to view in two of the preferred embodiments. If butt joints will be exposed, an easy guide is already prepared by the spacing of the uprights. The uprights give added strength per unit volume of wood for the fence while reducing the unit cost of the lumber.

This post may be used as a foundation for any wood frame structure which requires lateral stability and bearing, such as buildings, carports, mailboxes, decks, or other suitable wooden structures. Having two short uprights bolted to a metal tubular member, the post of this invention offers a variety of new and simple fence designs, all of which are easier to build, last longer, have new structural and esthetic appeal, and cost less to install than other comparable wood fences.

Additionally, the fence post of this invention may be used to renovate an older fence which has suffered the damage of wood rot. The posts may be easily attached to existing fence posts above the ground, reducing the cost of repairing a fence by saving the greatest amount of lumber from the existing fence.

BRIEF DESCRIPTION OF THE DRAWINGS

FIG. 1 is a side elevation of a preferred fence post of this invention.

FIG. 2 is a side elevation of a livestock fence showing a second embodiment of the post.

FIG. 3 is a side elevation of a flush-face fence.

FIG. 4 is a side elevation of an estate fence.

BEST MODE FOR CARRYING OUT THE INVENTION

Figure 5:
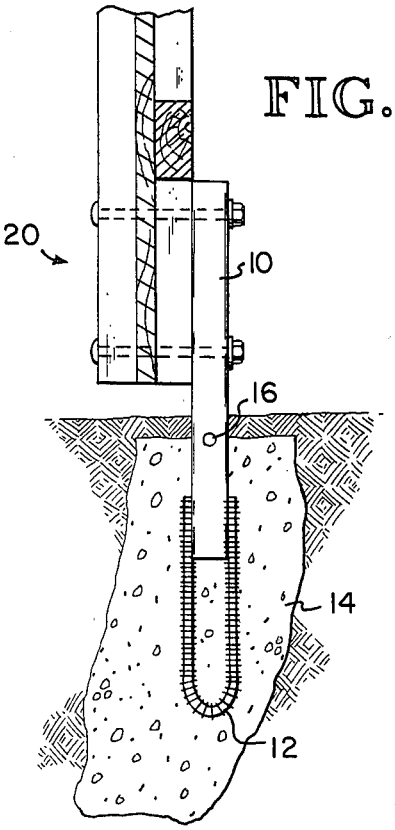
FIG. 5 is a side elevation of a fence post used to restore an existing fence.

The fence post of this invention has a one-and-one-half-inch ($1\frac{1}{2}\times1\frac{1}{2}$ in. or $3.8\times3.8$ cm) square, eighteen-inch (45.7 cm) long tubular member 10 which has a stirrup 12 of concrete reinforcing rod (rebar) welded to its bottom end. The member and stirrup are set in concrete 14 up to a weep hole 16 drilled in the member at a preset distance from its end. Preferably, the concrete reinforcing rod is three-eighth-inch (0.95 cm) rebar, forming a stirrup having at least about seven-inch (17.8 cm) sides. The concrete reinforcing rods will extend downwardly into the concrete and provide added strength for the concrete. Concrete will usually fill the tubular member to the point of the weep hole, making it easy to determine the depth to which to set the post. Above the weep hole and near the top end of the tubular member at least one bolt hole is drilled. Wooden uprights 18 are bolted to straddle the member. Two bolt holes are preferably spaced about seven inches (17.8 cm) apart through opposed sides of the tubular member in its top eight inches (20.3 cm). The weep hole is usually drilled on a third side from the bolt holes.

Figure 6:
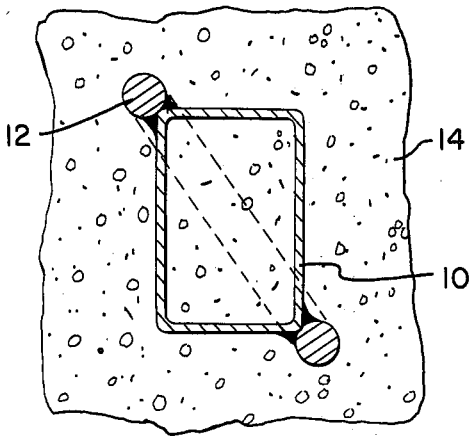
FIG. 6 is a detailed cross-section taken along line 6—6 of FIG. 1.
Figure 8:
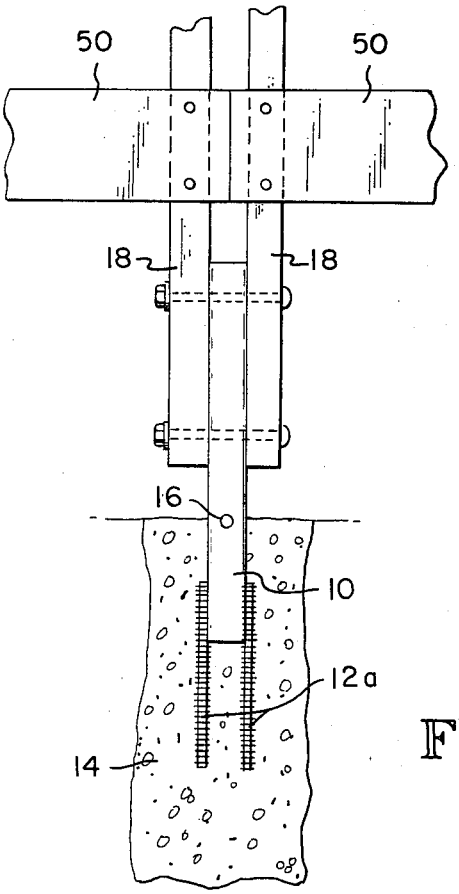
FIG. 8 is a detailed partial side elevation of a livestock fence as shown in FIG. 2.

The stirrup 12 is usually welded to the bottom of the tubular member 10 on non-adjacent corners, as best shown in FIG. 6. Slag may remain on the welds because the bottom end of the tubular member will be set in concrete. Instead of a stirrup (as shown in FIGS. 1 and 5), two concrete reinforcing rods **12*a* may be individually welded to non-adjacent corners of the tubular member (as shown in FIGS. 2 and 8**). Of course, additional reinforcing rods may be welded to other corners or portions of the tubular member, but these additional reinforcing rods will only increase the weight and cost of the tubular member while not appreciably increasing the strength which the post provides.

The weep hole 16 allows determination of the depth to which a post should be sunk in concrete. It also provides a drain for water which enters the open end of the tubular member. Because the weep hole is standardized in its position on the tubular member, it may be used to readily set a uniform height fence. This method of adjusting the height of the fence will be explained in greater detail later in this specification.

An old fence 20 (as shown in FIG. 5) may be repaired with the fence post of this invention. First, the fence is pulled back into line by whatever means is convenient, such as tieing the fence to trees or staking it. Second, the fence repair is planned so that every other post is repaired during one concrete setting to ensure that the fence will be supported during the repair. Third, at each post to be repaired, a hole is dug approximately six inches (15.2 cm) in diameter by eighteen to twenty-four inches (45.7 to 61 cm) in depth. Fourth, the rotten part of the posts and any concrete associated with them are removed. Fifth, the tubular member is held up to the part of the fence which is being saved. Sixth, two holes are drilled to receive the bolts which will pass through the tubular member. Seventh, concrete is poured into the hole, the tubular member is set with its concrete reinforcing rods in the concrete, and the member is attached to the fence. Eighth, the concrete is allowed to set for at least one day before the process is repeated for the other posts. If the ground is particularly soft, the upper sides of the hole should be tamped to ensure a sturdier concrete column in the ground. In particularly dry ground, initially filling the hole with water will improve the hole while the fence repair is performed.

Figure 7:
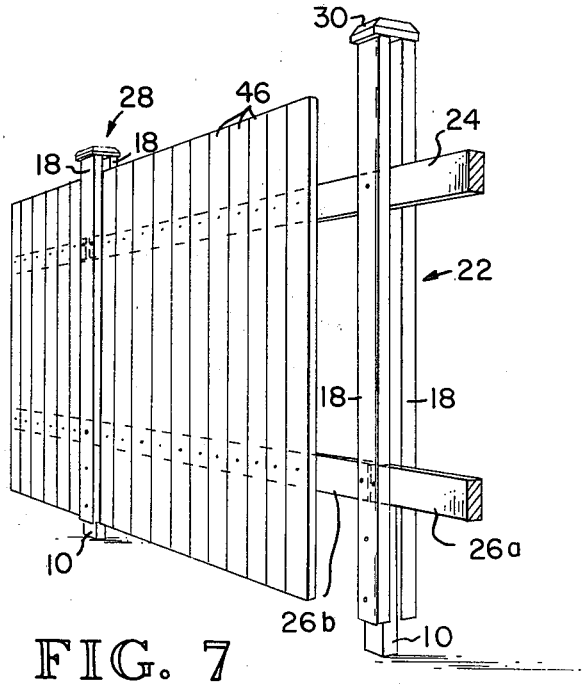
FIG. 7 is a perspective of an estate fence of this invention.

If installing a new fence with the fence posts of this invention rather than replacing old posts from an existing fence, the method of constructing the fence is appreciably different from customary fence installation. First, the steel tube and rebar assembly, called a "post saver," is placed into concrete in the ground. Second, the fence posts are made up on each post save by bolting two-by-fours ($1\frac{1}{2}\times3\frac{1}{2}$in. or $3.8\times8.9$ cm) to straddle the members. Third, for the estate fence shown in FIGS. 4 and 7, long two-by-four rails pass through the space between the uprights, and fence boards are nailed to the rails. If possible, rails should span three posts, with joints being staggered. As shown in FIG. 7, the near post 22 has an upper rail 24 spanning its uprights 18. At the bottom of the post 22, however, a joint is formed in the rails **26*a* and 26*b* at the uprights. Similarly, at the far post 28, a rail 24 ends at the uprights at the top of the fence, while the bottom rail 26*b*** spans the uprights and extends to the next fence post. This cantilever effect of the fence rails enables the fence posts to be placed at greater than the traditional eight-foot (244 cm) spacing. Precision cuts for the rails are substantially eliminated because toenailing or installing nail brackets to the sides of the fence post is eliminated with this construction. The uprights hide sloppily cut joints. Only at corners of the fence need there be precise cuts, and then only for rails on one side. These features and others reduce the material and labor costs for constructing this fence. Where the long rails cannot be used because of a change in grade along the fence line, the traditional eight-foot (244 cm) maximum center spacing. Without the cantilever effect of the spanning rails, the fence lacks the necessary strength to increase the spacing between posts.

On flat ground, the concrete should be filled to roughly one inch (2.54 cm) below the ground line, thereby allowing the lawn or garden to hide the concrete after minor backfill. For bumpy ground conditions, the grade of the fence can be laid out by eyeball or with a grade string. The elevation of the post top relative to the ground can vary up to at least five inches (12.7 cm). On a hill, one extreme would be to fill the concrete to only three inches (7.6 cm) below ground and set the post to where the weep hole is almost covered by the concrete. In a valley, the other extreme would be to fill the concrete to the ground line and hold the weep hole up to two inches (5.1 cm) above the concrete. When the posts are set to the proper grade, little, if any, top trim is required, and the rails will be parallel to the top and bottom of the fence.

The line of the fence is usually set with a string. Concrete is poured into the eighteen-to-twenty-four-inch (45.7–61 cm) deep fence holes up to the fill point as previously determined. A stick is then run up and down two or three strokes in each hole to ensure a good fill of cement. Each post is set in concrete to the weep hole or as previously determined, and the post is plumbed in both directions. At least one day should be allowed for the concrete to cure.

The two-by fours (3.8×8.9 cm) which will form the wooden uprights of the fence must be precut and predrilled so that they will be attachable to the posts. A tubular member may be used as a form to mark the drill holes on the uprights. Once drilled, the uprights are fixed to the posts with suitable bolts.

The lower horizontal rails, which are rough-cut in place to length, are placed so that the rail comes out flush on gates and corner posts and approximately reaches the middle of the uprights of the other posts. Gaps at the joints will hardly be noticed and will have little effect on the structure of the fence. Ordinarily, the lower horizontal rail will abut the top of the "post saver's" tubular member, but on bumpy ground, the lower rail may be nailed above the top. The lower rail should be nailed using sixteen-penny nails.

The higher horizontal rail is easily set by placing erection nails in the uprights prior to nailing. Again, long rails should be used to stagger the joints as much as possible. A C-clamp holds the rail plumb during nailing. Each upper rail should be nailed with sixteen-penny nails from each side of the uprights at each post.

Once the rails are erected, it is easy to nail fence boards to the rails. The estate fence, as shown in FIGS. 4 and 7, is formed by nailing the fence boards adjacent one another to span the entire distance between posts. Once nailed, minor deviations in height at the top of the fence may be easily corrected by cutting the boards along a smooth line. For a longer lasting fence, the bottom of the one-by-six (2.5×15.2 cm) boards should be off the ground. A quick and accurate way to position the boards is to lay a spacer on the ground when nailing the fence boards to the rails. Post tops 30 may be nailed to the top of the uprights for aesthetic appeal.

The livestock fence of this invention uses posts which are rotated ninety degrees and rails 50 which are attached across the face of the uprights (as shown in FIGS. 2 and 8). Posts are normally set at up to ten foot (305 cm) centers. The rails 50 are commonly one-by-six (2.5×15.2 cm) boards of twenty-foot (610 cm) length. At every other post, the fence rails are overlapped, if necessary, and are cut together to form tight joints. The livestock fence is an improvement over many fences of this nature because the spaced uprights allow the nailing of the rails relatively far away from the ends, reducing the tendency of the rails to split. The built-in guides formed by the spaces between the uprights also allow rapid cutting and assembly of this fence.

A flush-face fence (as shown in FIG. 3) uses different length uprights to incorporate the rails flush to the face of the posts. A first rail 36 is placed atop the shorter upright 32. Between the shorter upright 32 and longer upright 34 and the top of the tubular member 10, an upright spacer board 38 is placed. A second upright spacer 40 is placed atop the first rail 36 in line with the shorter upright 32. At its bottom, the upright 40 is nailed to the spacer board 38. At its top, the upright 40 is nailed to a top support 42 which is also nailed to the longer upright 34. A top rail 44 is placed above the upright 40 to form a four-piece upright substantially equal in height to the longer upright 34. With this construction, each fence post has rails incorporated in it and uprights that are flush with the rails. Therefore, fence boards 46 may be nailed directly along the rails to form a smooth surface. As with the estate fence, long rails that span three posts are used staggered rail joints are preferred.

Figure 9:
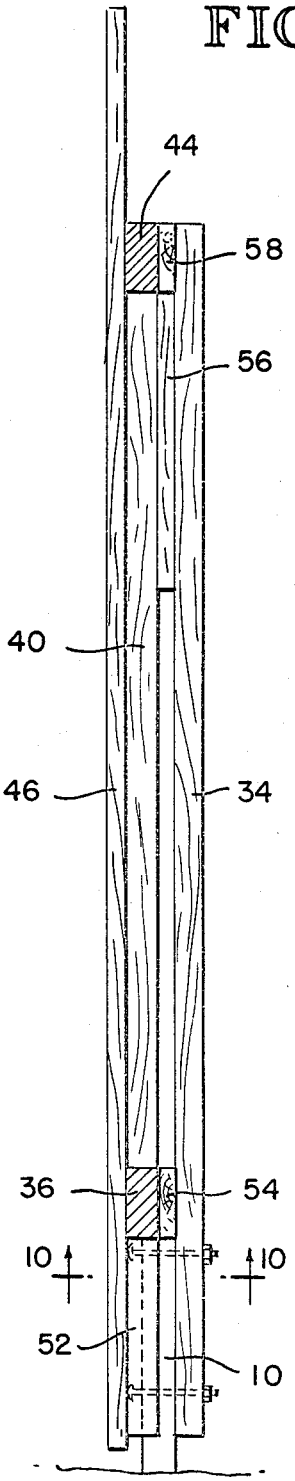
FIG. 9 is a side elevation of an alternate flush-face fence.
Figure 10:
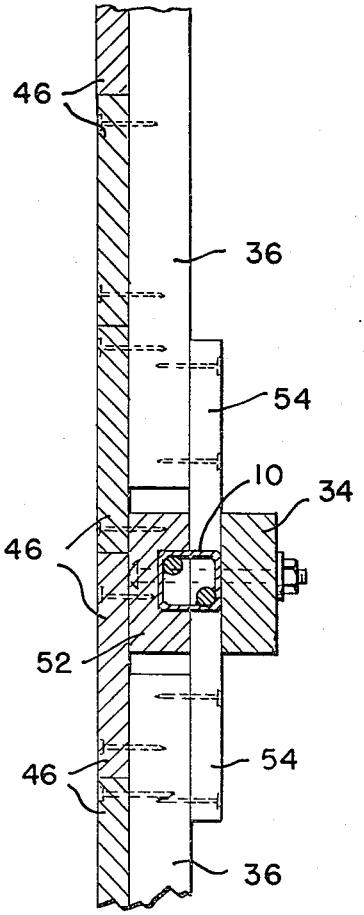
FIG. 10 is a section through the fence of FIG. 9, taken along line 10—10.

An alternative flush-face fence is shown in FIGS. 9 and 10. This fence uses a grooved lower upright 52 to give the fence a sleeker cross-section. Support boards 54 give added strength to the bottom of the fence. Near the top, two short spacers 56 and 58 connect the longer upright 34 with the sectioned upright. In some cases, uprights 40 and 52 may be a single piece with rails 36 stopping at each post. However, spanning rails may still be used if a properly slotted bottom member is used. The rail 36 will then sit atop the tubular member 10.

I claim:

1. A fence post for setting in concrete, comprising:

(a) a metal tubular member having four corners and at least one bolt hole extending through opposed sides of the member near one end;

(b) two concrete reinforcing rods projecting downwardly from the other end of the member from non-adjacent corners; and (c) at least two uprights bolted to the member to project upwardly from the member opposite the rods, wherein the two uprights straddle the member.

2. The post of claim 1 wherein the uprights are fastened to the member with at least two spaced bolts extending through the uprights and the member.

3. The post of claim 1 wherein the rods are connected together to form a looped stirrup projecting downwardly from the member.

4. A fence post for setting in concrete, comprising:

(a) a metal, rectangular, tubular member having two spaced bolt holes extending through opposed sides of the member near one end;

(b) a stirrup of concrete reinforcing rod projecting downwardly from the other end of the member from non-adjacent corners; and (c) uprights straddling the member and bolted thereto to project upwardly from the member.

5. The post of claim 4, further comprising a weep hole drilled through a side of the member to allow water to weep from the member and to allow ready regulation of the depth to which the post is set.

6. An estate fence that substantially eliminates toenailing or installing nail brackets and that eliminates precision cutting in making joints, comprising:

(a) a plurality of posts, each post having (i) a metal, rectangular, tubular member set in concrete in the ground having at least one bolt hole extending through opposed sides of the member near one end, (ii) two uprights projecting upwardly from the member, straddling the member, and bolted thereto, and (iii) a plurality of concrete reinforcing rods projecting downwardly into the concrete from non-adjacent corners of the other end of the member and extending into the concrete to provide added strength to the concrete; and (b) rails near the top and bottom of the uprights positioned in the space between the uprights and attached to the uprights with staggered joints concealed by the uprights; and (c) fence boards attached to the rails between the posts.

7. A livestock fence that provides for fast and accurate rail installation, comprising:

(a) a plurality of posts, each post having (i) a metal, rectangular, tubular member set in concrete in the ground and having at least one bolt hole extending through opposed sides of the member near one end, (ii) two uprights projecting upwardly from the member, bolted thereto, and straddling the member, and (iii) a plurality of concrete reinforcing rods projecting downwardly from non-adjacent corners of the other end of the member and extending into the concrete to provide added strength to the concrete; and (b) a plurality of rails attached horizontally in spaced rows along the uprights and having staggered joints at every other upright, wherein the rail joints at each upright are in substantial abutment.

8. A flush-face fence that substantially eliminates toenailing or installing nail brackets and that eliminates precision cutting of rails, comprising:

(a) a plurality of posts, each post having (i) a metal, rectangular, tubular member set in concrete in the ground and having at least one bolt hole extending through opposed sides of the member near one end, (ii) two uprights of differing lengths projecting upwardly from the member, bolted thereto, and straddling the member, and (iii) a plurality of concrete reinforcing rods projecting downwardly from non-adjacent corners of the other end of the member and extending into the concrete to provide added strength for the concrete;

(b) a spacer board atop the member between the uprights;

(c) a first rail atop the shorter upright;

(d) an upright spacer atop the first rail and attached to the spacer board;

(e) a second rail atop the upright spacer to make the first and second rails, the shorter upright and the upright spacer a line substantially equal in height to the length of the the longer upright;

(f) a top support attached to the upright spacer, top rail, and the longer upright to strengthen the fence near its top and to fill the space between these members; and (g) fence boards attached to the rails along the face of the fence.

9. A method of making a wooden livestock fence, comprising the steps of:

(a) attaching uprights in straddling position about a metal tubular member to form a post;

(b) setting at least three posts in concrete in the ground to define the fence line so that the uprights straddle the fence line;

(c) cutting rails to length at every other post to form meshing joints by overlapping the unattached rails and cutting them by using the space between the uprights of the post as a guide; and (d) attaching the rails to the uprights so that the rails in a row are in substantial abutment.

10. A method of making a wooden fence, comprising the steps of:

(a) digging a plurality of post holes;

(b) filling the post holes with the desired amount of concrete;

(c) setting a metal tubular member in the cement of each post hole to the desired depth;

(d) curing the concrete;

(e) bolting uprights to straddle the tubular member;

(f) running rails in the space provided between uprights; and (g) nailing fence boards to the rails to form a completed fence.

* * * * *